US011846289B2

(12) United States Patent
Choi

(10) Patent No.: US 11,846,289 B2
(45) Date of Patent: Dec. 19, 2023

(54) THROUGH-TYPE DRAIN PUMP FOR FLUID DRAINING APPARATUS OF FLUID PIPE

(71) Applicant: Sang Ho Choi, Gyeonggi-do (KR)

(72) Inventor: Sang Ho Choi, Gyeonggi-do (KR)

(73) Assignee: Sang Ho Choi, Gyeonggi-do (KR)

( * ) Notice: Subject to any disclaimer, the term of this patent is extended or adjusted under 35 U.S.C. 154(b) by 0 days.

(21) Appl. No.: 17/940,458

(22) Filed: Sep. 8, 2022

(65) Prior Publication Data

US 2023/0082156 A1 Mar. 16, 2023

(30) Foreign Application Priority Data

Sep. 13, 2021 (KR) ..... 10-2021-0121618

(51) Int. Cl.

| | |
|---|---|
| ***F04D 13/00*** | (2006.01) |
| ***F04D 29/60*** | (2006.01) |
| ***F04D 13/02*** | (2006.01) |
| ***F04D 13/04*** | (2006.01) |

(52) U.S. Cl.

CPC ..... *F04D 13/00* (2013.01); *F04D 13/02* (2013.01); *F04D 13/04* (2013.01); *F04D 29/604* (2013.01); *F04D 29/605* (2013.01)

(58) Field of Classification Search

CPC ..... F04D 13/00; F04D 13/02; F04D 13/04; F04D 29/604; F04D 29/605

See application file for complete search history.

(56) References Cited

U.S. PATENT DOCUMENTS 1,170,512 A * 2/1916 Chapman ..... F04D 13/02 417/423.12
4,230,440 A * 10/1980 Niedermeyer ..... F04D 13/10 417/423.15

(Continued)

FOREIGN PATENT DOCUMENTS

CN 211314677 * 11/2019 ..... F04D 29/70
CN 211314677 U 8/2020

(Continued)

OTHER PUBLICATIONS

Office Action for Korean Application No. 10-2021-0121618, dated Mar. 7, 2022, 3 pages.

(Continued)

*Primary Examiner* — Eldon T Brockman
*Assistant Examiner* — Andrew J Marien
(74) *Attorney, Agent, or Firm* — Lippes Mathias LLP

(57) ABSTRACT

Proposed is a through type drain pump for a fluid draining apparatus of a fluid pipe. The drain pump includes: a housing formed in a hollow cylindrical shape, the housing being configured such that a fluid inlet port and a fluid outlet port are in communication with each other via a fluid movement path; a rotary shaft having a driving motor, the rotary shaft being rotatably coupled to an output shaft of the driving motor via a coupler; an impeller formed at a lower end of the rotary shaft and configured to be rotated so that the fluid is moved to the fluid outlet port through the fluid movement path; and a mounter mounted at a lower outer side surface of the housing and configured to mount the drain pump on any pipe such that the drain pump is capable of being lifted and inserted into the pipe.

1 Claim, 12 Drawing Sheets

(56) References Cited

U.S. PATENT DOCUMENTS

| | | | | |
|---|---|---|---|---|
| 6,474,962 | B1 * | 11/2002 | Allen | F04D 3/02 417/423.15 |
| 9,291,160 | B2 * | 3/2016 | Quam | F04B 49/02 |
| 11,346,347 | B2 * | 5/2022 | Smith | F04D 13/16 |
| 2013/0129485 | A1 * | 5/2013 | Kucuk | F04D 13/06 415/124.2 |

FOREIGN PATENT DOCUMENTS

| | | | | |
|---|---|---|---|---|
| CN | 112112839 | * | 10/2020 | F04D 29/007 |
| KR | 1020080011444 | B1 | 2/2008 | |
| KR | 1020110101684 | A | 9/2011 | |
| KR | 1012940300000 | B1 | 8/2013 | |
| KR | 1015502760000 | B1 | 9/2015 | |
| KR | 1021361420000 | B1 | 7/2020 | |

OTHER PUBLICATIONS

Decision to Grant for Korean Application No. 10-2021-0121618, dated Feb. 28, 2022, 1 page.

* cited by examiner

THROUGH-TYPE DRAIN PUMP FOR FLUID DRAINING APPARATUS OF FLUID PIPE

CROSS REFERENCE TO RELATED APPLICATION

The present application claims priority to Korean Patent Application No. 10-2021-0121618, filed Sep. 13, 2021, the entire contents of which are incorporated herein for all purposes by this reference.

BACKGROUND OF THE INVENTION

Field of the Invention

The present disclosure relates to a drain pump. More particularly, the present disclosure relates to a through-type drain pump for a fluid draining apparatus of a fluid pipe, the through-type drain pump being configured to drain a fluid (for an example, tap water, chemically-treated hot water for heating, and so on) inside a pipe through which the fluid flows, such as an old pipe, by being inserted into the pipe while the pipe is in a state in which the fluid remains therein.

Description of the Related Art

Unless otherwise indicated herein, the content described in this section is not conventional art for the claims of this application, and is not admitted to be the conventional art by inclusion in this section.

Generally, in order to transport various fluids, pipes such as a gas pipe, an oil transport pipe, a heating water pipe, a water supply pipe, and so on are laid underground in a city.

In such pipes, when maintenance work, such as replacement of a valve, installation of the pipe, movement of the pipe, replacement of an old pipe with a new pipe, or the like is performed, non-water blockage piping work that allows the maintenance work to be performed while a fluid can continuously flow except for a portion where the maintenance work is performed is performed when a branch pipe is connected to a main pipe through which the fluid flows or when an old pipe is replaced.

As described above, when repair work is performed on a specific portion of a pipe, the pipe where leakage occurs is replaced while a chemically-treated fluid (as an example, hot water for heating) remaining in the pipe is not discharged to the outside. Therefore, when the repair work of the pipe is performed, the fluid remaining in the pipe may flow into the atmosphere or ground, so that environmental pollution around the workplace may occur.

Particularly, hot water for heating having a high temperature (as an example, about 120° C.) contains harmful substances such as chemicals and so on. Therefore, when the hot water leaks into soil, there is a problem that the hot water may cause pollution of the atmosphere, ground water, and soil.

In Korean Patent No. 10-1550276 (Sep. 7, 2015), a vertical pump has been registered.

SUMMARY OF THE INVENTION

An embodiment of the present disclosure relates to a through-type drain pump for a fluid draining apparatus of a fluid pipe, the through-type drain pump being configured to drain a fluid remaining inside a pipe so as to perform maintenance work such as a replacement of an old pipe, connecting a branch pipe or the like to a main pipe, or the like, and the through-type drain pump being configured to increase workability of installing, inserting, and separating of the drain pump to the pipe.

In order to achieve the above objective, according to an embodiment of the present disclosure, there is provided a through-type drain pump for a fluid draining apparatus of a fluid pipe, the drain pump including: a housing formed in a hollow cylindrical shape, the housing being configured such that a fluid inlet port formed at a lower portion of the housing and a fluid outlet port formed at an upper portion of the housing are in communication with each other via a fluid movement path; a rotary shaft which is formed in a long axis shape and which has a driving motor that is mounted on the upper portion of the housing, the rotary shaft being rotatably coupled to an output shaft of the driving motor via a coupler, and the rotary shaft being accommodated in the housing; an impeller formed at a lower end of the rotary shaft, the impeller being configured to move the fluid introduced through the fluid inlet port to the fluid outlet port through the fluid movement path when the impeller is rotated; and a mounter mounted at a lower outer side surface of the housing, the mounter being configured to mount the drain pump on any pipe in which the fluid flows such that the drain pump is capable of being lifted and inserted into the pipe.

The through-type drain pump for the fluid draining apparatus of the fluid pipe according to an embodiment of the present disclosure, which has the configuration as described above, has an advantage as follows.

When the maintenance work such as a replacement of an old pipe, connecting a branch pipe or the like to a main pipe is performed, installing, inserting, and separating of the drain pump to or from the pipe so as to drain the fluid remaining inside the pipe is easily performed, so that an unskilled person in the field may easily use the through-type drain pump.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
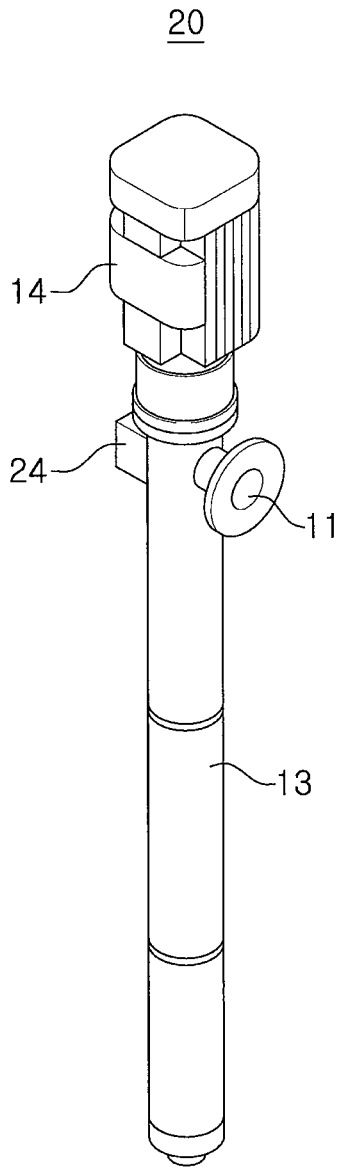
FIG. 1 is a perspective view illustrating a through-type drain pump for a fluid draining apparatus of a fluid pipe according to an exemplary embodiment of the present disclosure.
Figure 2:
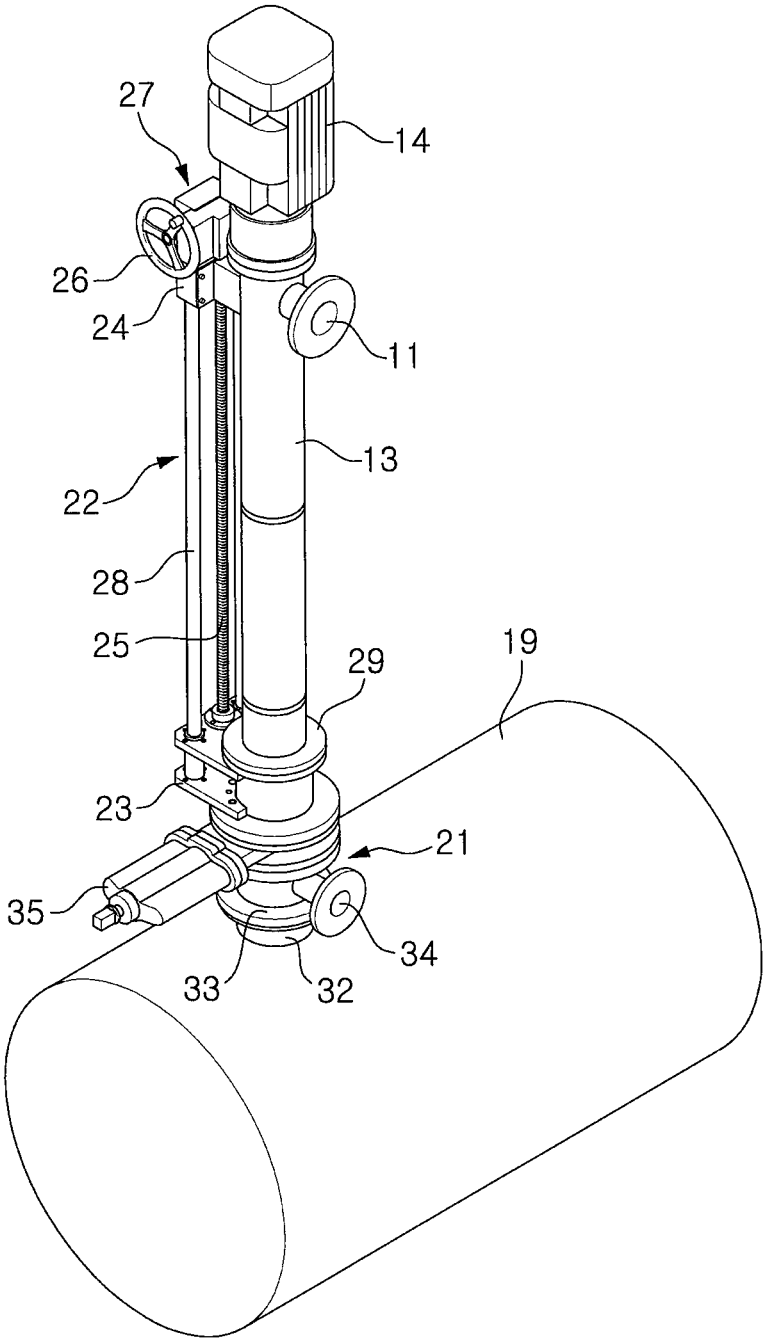
FIG. 2 is a perspective view illustrating a use state of the drain pump illustrated in FIG. 1.

Hereinafter, a through-type drain pump for a fluid draining apparatus of a fluid pipe according to an exemplary embodiment of the present disclosure will be described in detail with reference to the accompanying drawings.

Referring to FIGS. 1 to 7F, the through-type drain pump for the fluid draining apparatus of the fluid pipe according to an embodiment of the present disclosure is applied to a through-type drain pump that is for draining a fluid remaining inside a pipe to the outside, in which the pipe is a pipe having a working section where a predetermined maintenance work is required. The predetermined maintenance work is required when a first side of any pipe through which the fluid flows is damaged or when a branch pipe (not illustrated) is connected to the pipe. The through-type drain pump for the fluid draining apparatus of the fluid pipe according to an embodiment of the present disclosure includes: a housing 13 formed in a hollow cylindrical shape, the housing 13 being configured such that a fluid inlet port 10 formed at a lower portion of the housing 13 and a fluid outlet port 11 formed at an upper portion of the housing 13 are in communication with each other via a fluid movement path 12; a rotary shaft 17 which is formed in a long axis shape and which has a driving motor 14 that is mounted on the upper portion of the housing 13, the rotary shaft 17 being rotatably connected to an output shaft 15 of the driving motor 14 via a coupler 16, and the rotary shaft 17 being accommodated in the housing 13; an impeller 18 which is formed in at least one stage and which is formed at a lower end of the rotary shaft 17, the impeller 18 being configured to move a fluid that is introduced through the fluid inlet port 10 toward the fluid outlet port 11 through the fluid movement path 12 when the impeller 18 is rotated; and a mounter 21 mounted at a lower outer side surface of the housing 13, the mounter 21 being configured to mount a drain pump 20 on an any pipe 19 in which the fluid flows such that the drain pump 20 is capable of being lifted and inserted into the pipe 19.

According to a more preferred embodiment, an actuator 22 for lifting the drain pump 20 includes: a lower fixing piece 23 mounted at the mounter 21; a lead screw 25 having a lower end rotatably coupled to the lower fixing piece 23 and having an outer side surface provided with a screw portion, the lead screw 25 being configured to lift a supporter 24 that is mounted at an upper outer side surface of the housing 13; a gear box 27 formed on an upper end of the lead screw 25, the gear box 27 being configured to lift the supporter 24 according to a rotation direction of the lead screw 25 by an operation of a handle 26; and at least one guide shaft 28 having a lower end fixed to the lower fixing piece 28 and having an upper end fixed to the gear box 27, the guide shaft 28 being configured to guide a lift movement of the supporter 24 according to a rotation of the lead screw 25.

Further, the through-type drain pump for the fluid draining apparatus of the fluid pipe further includes a shaking prevention flange 29 which is coupled to the outer side surface of the housing 13 and which is mounted on an upper surface of the mounter 21, the shaking prevention flange 29 being configured to prevent shaking of the housing 13 when the drain pump 20 is lifted or when the rotary shaft 17 is rotated.

Accordingly, when the rotary shaft 17 having the long axis is rotated by driving the driving motor 14 that is described above, the housing 13 is capable of being stably supported by the shaking prevention flange 29 which is mounted on the mounter 21 and which supports the outer side surface of the housing 13.

The drain pump 20 described above includes a sleeve bearing 31 including a bushing 30 that is configured to rotatably support the rotary shaft 17 from an arbitrary position inside the housing 13 so that the rotary shaft 17 is prevented from shaking when the rotary shaft 17 is rotated.

The sleeve bearing 31 configured to prevent the shaking of the rotary shaft 17 having the long axis shape is conventionally used in the technical field to which the present disclosure belongs, so that detailed description thereof will be omitted.

In the drawings, reference numeral 39, which is not described, is an O-ring, and the O-ring is configured to guide the lift movement of the housing 13 and is configured such that at least one O-ring is mounted at an inner side surface of the mounter 21.

Hereinafter, the through-type drain pump for the fluid draining apparatus of the fluid pipe according to an embodiment of the present disclosure will be described with reference to the accompanying drawings.

Figure 7A:
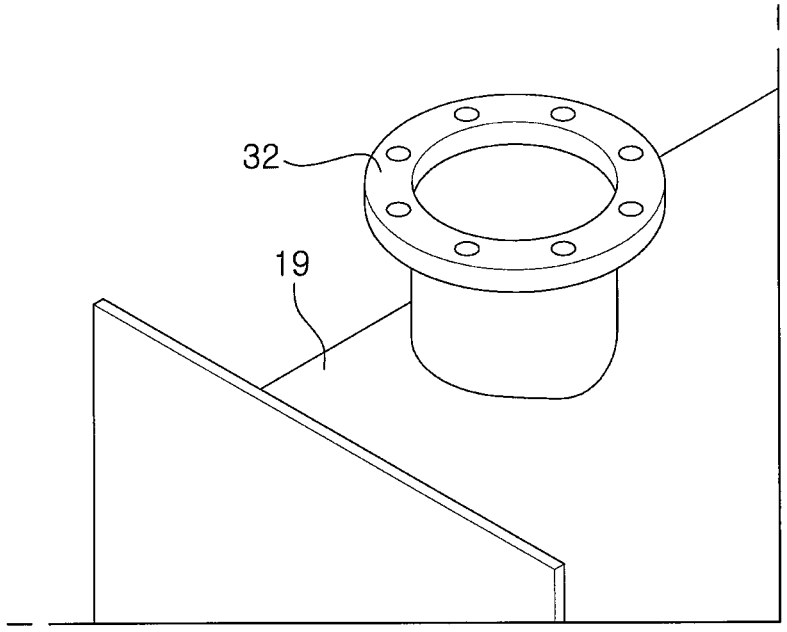
FIGS. 7A to 7F are photographs substitute for a drawing illustrating a use state of the through-type drain pump for the fluid draining apparatus of the fluid pipe illustrated in FIG.

As illustrated in FIG. 7A, when a first side of the pipe 19 described above leaks and is required to be repaired, a flange 32 is fixed to the first side of the pipe 19 by welding.

Figure 7B:
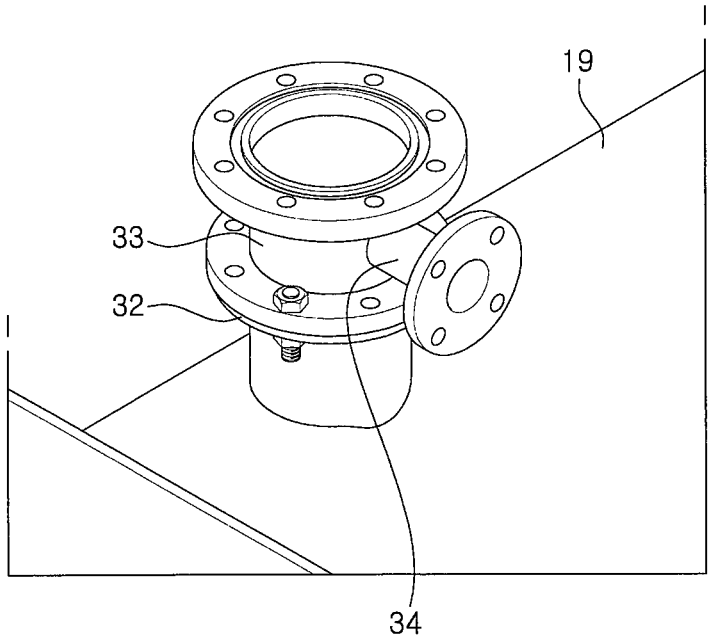

As illustrated in FIG. 7B, a branch fit 33 in which a pressure removal hole 34 (referring to a hole for removing a pressure inside the pipe 19 that is perforated) is formed is mounted on the flange 32.

Figure 7C:
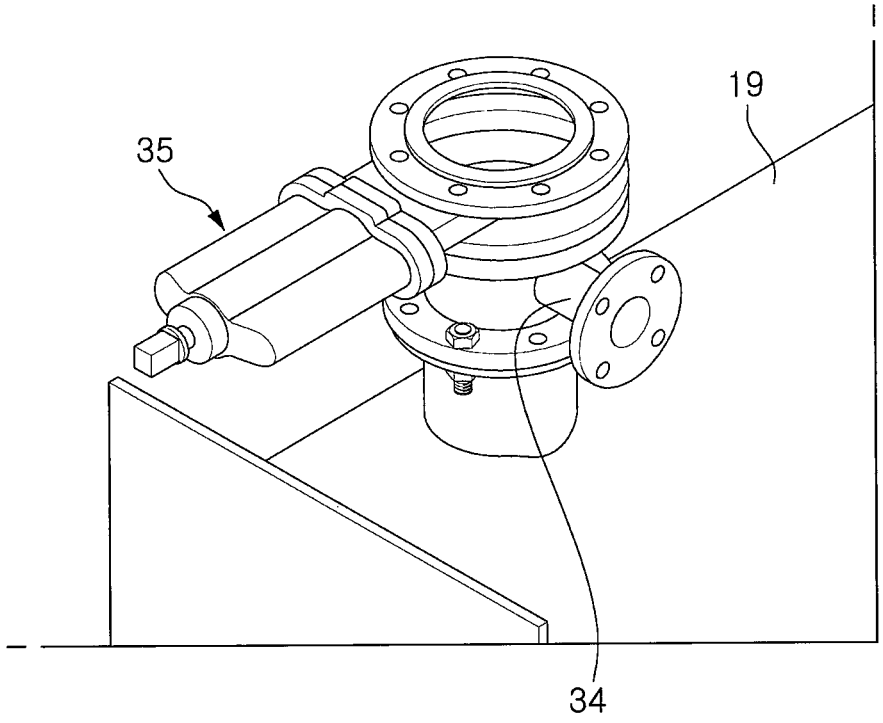

As illustrated in FIG. 7C, a pressure removal valve 35 is mounted on the branch fit 33. A knife valve (as an example, referring to a sandwich valve) may be used as the pressure removal valve 35, which is an example to aid understanding, so that the pressure removal valve 35 is not limited to the knife valve.

Figure 7D:
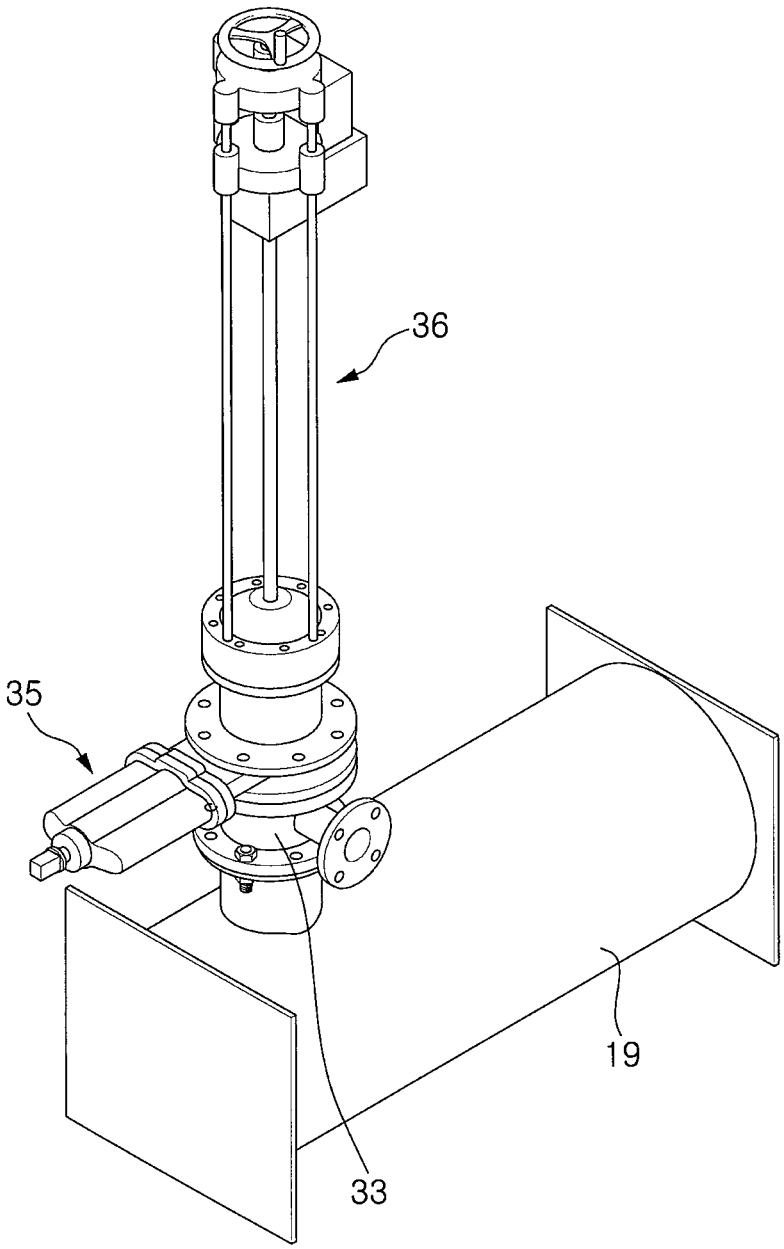

As illustrated in FIG. 7D, a conventional drilling machine 36 is mounted on a flange of the pressure removal valve 35 described above.

After a hole is formed in the pipe 19 by passing a cutter (as an example, referring to a wheel cutter that is not illustrated) of the drilling machine 36 through the branch fit 33 and the flange 32, the drilling machine 36 is removed from the flange of the pressure removal valve 35.

After the drilling machine 36 is removed, the pressure removal valve 35 is operated so as to remove the pressure inside the pipe 19, so that the pressure inside the pipe 19 is removed.

At this time, the technical content of forming the hole in the pipe 19 by using the cutter of the drilling machine 36 is conventionally used in the technical field to which the present disclosure belongs, so that the detailed description thereof will be omitted.

Figure 7E:
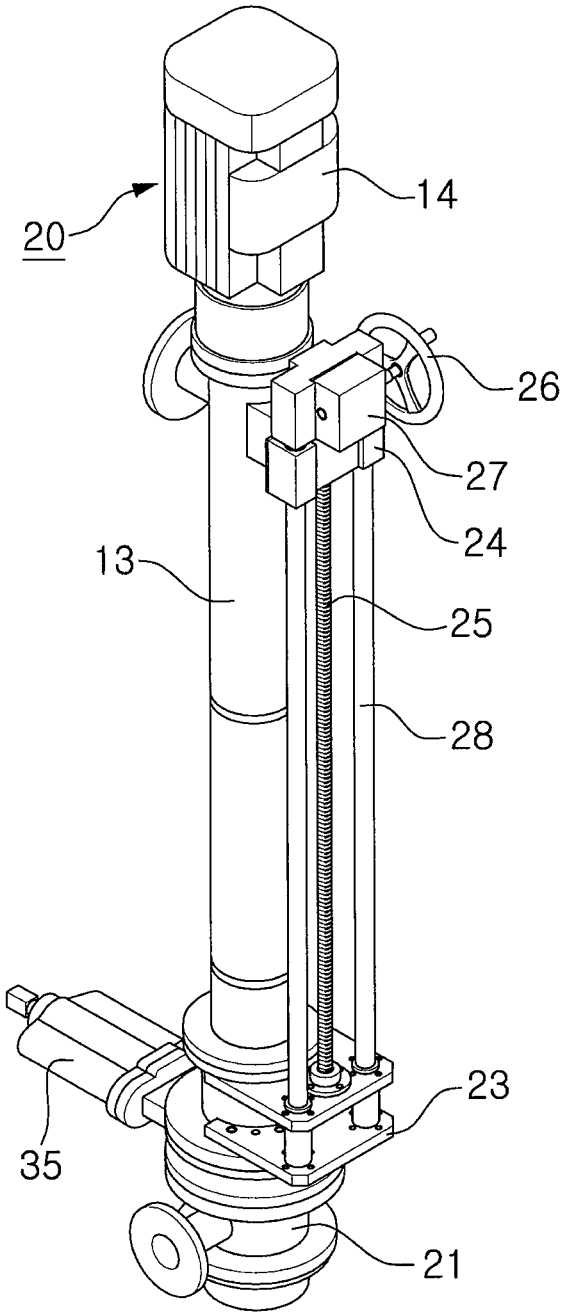
Figure 7F:
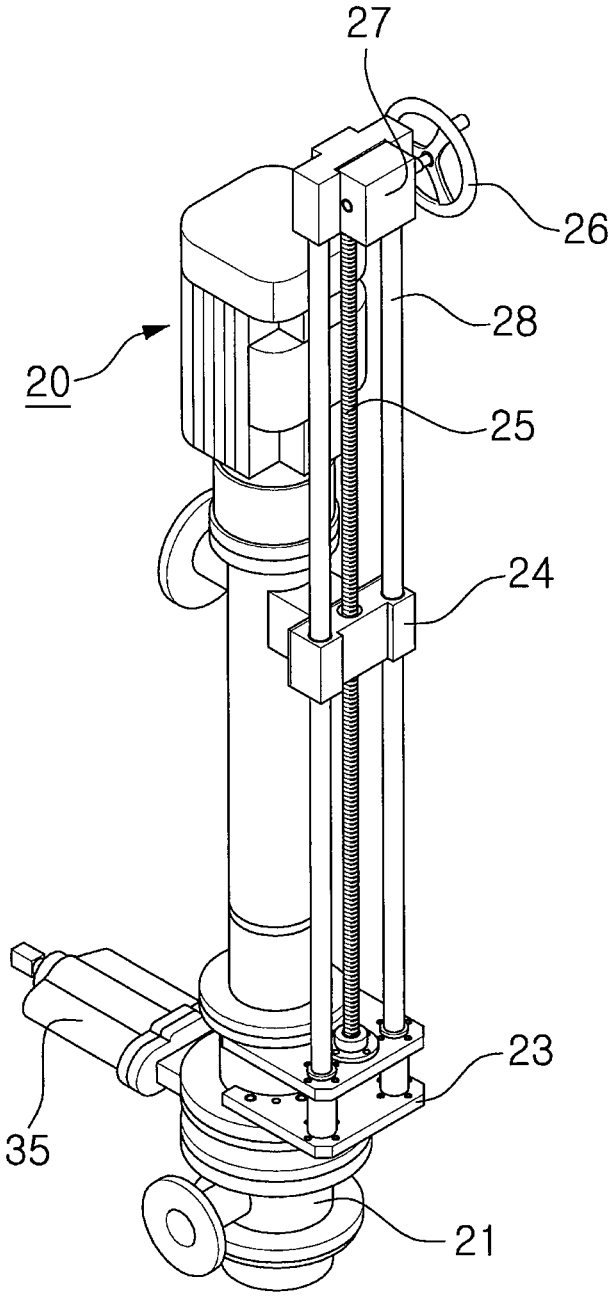

As illustrated in FIG. 7E, the mounter 21 of the drain pump 20 is mounted on the flange of the pressure removal valve 35.

As illustrated in FIGS. 1 to 6B, and FIGS. 7E and 7F, the housing 13 of the drain pump 20 described above 20 is inserted inside the pipe 29 by passing the housing 13 sequentially through the flange of the pressure removal valve 35, the branch fit 33, and the flange 32, the remaining fluid inside the pipe 19 is capable of being drained.

Figure 5:
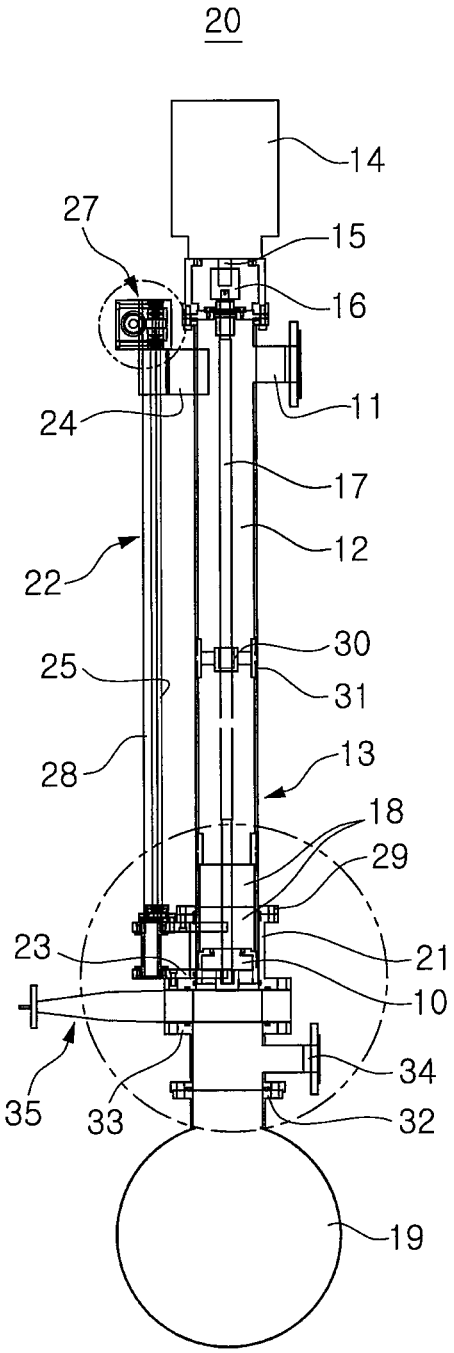
FIG. 5 is a cross-sectional view schematically illustrating the drain pump illustrated in FIG. 2.
Figure 6A:
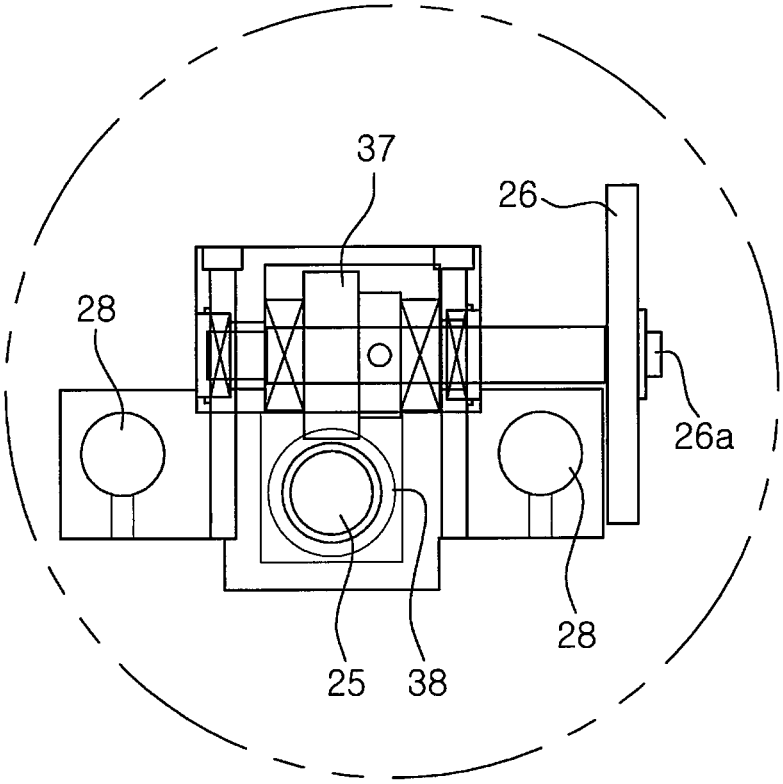
FIGS. 6A and 6B are enlarged views illustrating a driving force generating portion that lifts the drain pump illustrated in FIG. 5.
Figure 6B:
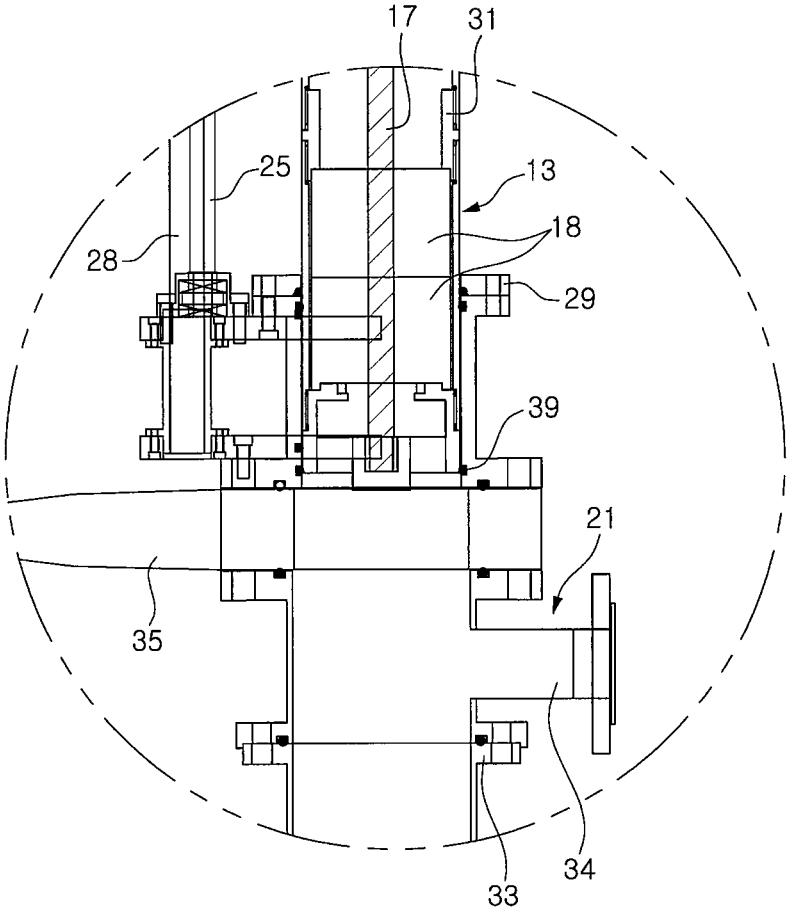

In detail, as illustrated in FIG. 5, since a first gear 37 mounted at a rotary shaft 26*a* of the handle 26 and a second gear 38 formed on an upper end of the lead screw 25 are engaged with each other, the lead screw 25 is capable of being rotated when the handle 26 of the gear box 27 described above is rotated.

At this time, the technical content of rotating the lead screw 25 in a forward direction or a reverse direction, in which the lead screw 25 is capable of being rotated when the handle 26 is rotated since the first and second gears 37 and 38 are engaged with each other, is conventionally used in the technical field to which the present disclosure belongs, so that the detailed description thereof will be omitted.

The actuator 22, which lifts the supporter 24 by the lead screw 25 that is rotated in conjunction with the rotation of the handle 26 described above so that the housing 13 (i.e. the drain pump 20) is lifted, is described as an example is not limited thereto.

The upper end and the lower end of the lead screw 25 described above are rotatably supported by bearings (reference numeral thereof is not illustrated) that are respectively mounted at the gear box 27 and the lower fixing piece 23.

Figure 3:
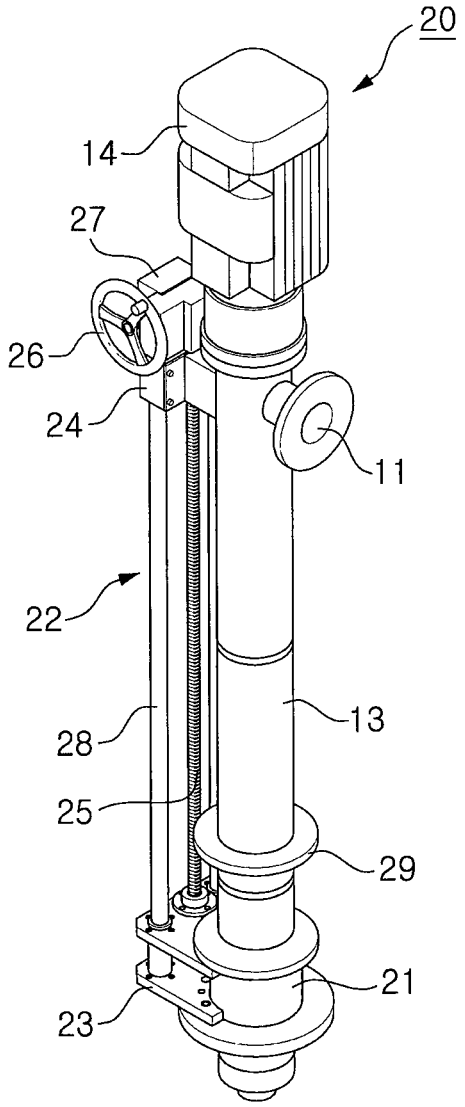
FIG. 3 is a perspective view illustrating the drain pump illustrated in FIG. 1.
Figure 4:
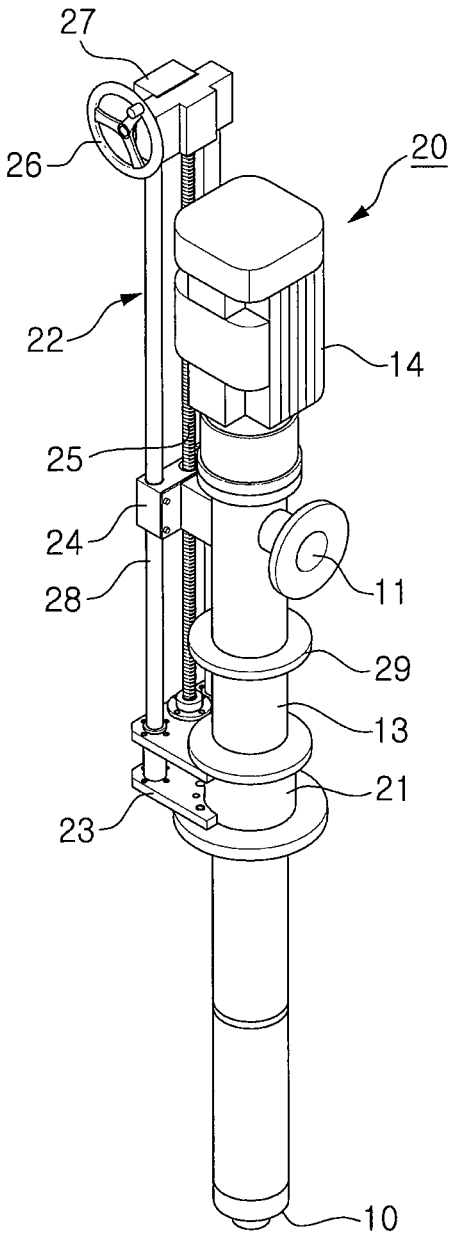
FIG. 4 is a perspective view illustrating a state in which the drain pump illustrated in FIG. 3 is moved downward.

As illustrated in FIGS. 3 and 4, when the handle 26 described above is rotated in the forward direction (clockwise direction), the supporter 24 is moved downward by the lead screw 25 that is rotated in conjunction with the rotation of the handle 26, so that the housing 13 (i.e. the drain pump 20) having the upper outer side surface coupled to the supporter 24 is capable of being moved downward (referring to inserting) to the inside of the pipe 19 (that is, when the housing 13 is moved downward to the inside of the pipe 19 by rotating the handle 26, the mounter 21 and the gear box 27 are in a fixed state, and the supporter 24 is moved along the lead screw 25.

Therefore, when the driving motor 14 mounted on the upper end of the housing 13 of the drain pump 20 is operated, the rotary shaft 17 coupled to the output shaft 15 of the driving motor 14 via the coupler 16 may be rotated.

Accordingly, as the impeller 18 mounted at the lower end of the rotary shaft 17 is rotated, the fluid inside the pipe 19 is suctioned to the housing 13 through the fluid inlet port 10 that is formed through the lower end of the housing 13, and the fluid is moved upward through the fluid movement path 12 inside the housing 13, so that the fluid may be discharged to the outside of the drain pump 20 through the fluid outlet port 11 that is formed at the upper end of the housing 13.

Although the exemplary embodiment of the present disclosure has been described above, it may be understood by those skilled in the art that a variety of modifications and changes may be made without departing from the concept and scope of the present disclosure disclosed within the range of the following claims.

What is claimed is:

1. A through-type drain pump for a fluid draining apparatus of a fluid pipe, the drain pump comprising:

a housing formed in a hollow cylindrical shape, the housing being configured such that a fluid inlet port formed at a lower portion of the housing and a fluid outlet port formed at an upper portion of the housing are in communication with each other via a fluid movement path;

a rotary shaft which is formed in a long axis shape and which has a driving motor that is mounted on the upper portion of the housing, the rotary shaft being rotatably coupled to an output shaft of the driving motor via a coupler, and the rotary shaft being accommodated in the housing;

an impeller formed at a lower end of the rotary shaft, the impeller being configured to move the fluid introduced through the fluid inlet port to the fluid outlet port through the fluid movement path when the impeller is rotated; and a mounter mounted at an outer side surface of the housing, the mounter being configured to mount the drain pump on any pipe in which the fluid flows such that the drain pump is capable of being lifted and inserted into the pipe, a shaking prevention flange which is coupled to the outer side surface of the housing and which is mounted on an upper surface of the mounter, wherein the shaking prevention flange is configured to prevent shaking of the housing when the drain pump is lifted or when the rotary shaft is rotated, wherein an actuator is provided to lift the drain pump, the actuator comprising:

a lower fixing piece mounted at the mounter;

a lead screw having a lower end rotatably coupled to the lower fixing piece and having an outer side surface provided with a screw portion, the lead screw being configured to lift a supporter that is mounted on an upper outer side surface of the housing;

a gear box formed on an upper end of the lead screw, the gear box being configured to lift the supporter according to a rotation direction of the lead screw by an operation of a handle; and a guide shaft having a lower end fixed to the lower fixing piece and having an upper end fixed to the gear box, the guide shaft being configured to guide a lift movement of the supporter according to a rotation of the lead screw, wherein, when the rotary shaft having the long axis shape is rotated by driving the driving motor, the housing is stably supported by the shaking prevention flange which is mounted on the mounter and which supports the outer side surface of the housing.

* * * * *